US006382996B1

(12) United States Patent
Eyman

(10) Patent No.: US 6,382,996 B1
(45) Date of Patent: May 7, 2002

(54) WORLDWIDE ADAPTOR PLUG

(75) Inventor: David W. Eyman, Cincinnati, OH (US)

(73) Assignee: E & B Giftware LLC, Yonkers, NY (US)

( * ) Notice: Subject to any disclaimer, the term of this patent is extended or adjusted under 35 U.S.C. 154(b) by 0 days.

(21) Appl. No.: 09/877,997

(22) Filed: Jun. 11, 2001

(51) Int. Cl.[7] ..... H01R 29/00
(52) U.S. Cl. ..... 439/172
(58) Field of Search ..... 439/169–174, 439/651, 652, 103, 104, 131

(56) References Cited

U.S. PATENT DOCUMENTS 3,025,486 A * 3/1962 Falconer ..... 439/172
4,626,052 A * 12/1986 Rumble ..... 439/173
4,856,999 A 8/1989 Flohr
5,159,545 A 10/1992 Lee
5,791,921 A 8/1998 Lee
5,967,807 A * 10/1999 Wu ..... 439/956 X
6,062,884 A * 5/2000 Messimer et al. ..... 439/172

* cited by examiner

*Primary Examiner*—Tulsidas Patel
*Assistant Examiner*—Son V. Nguyen
(74) *Attorney, Agent, or Firm*—Stanley J. Yavner

(57) ABSTRACT

A universal adaptor plug is disclosed as an encased arrangement of elements, which includes a single rotatable knob for attachment to and for rotation of a cam axis for mounting at least three cam elements. The front face of the casing defines openings through which project multiple sets of plug pins movable by the cams and cam followers. Each set of plug pins is attached to a base which causes retracting of the plug pins by the base's attachment to retracting springs. The continuous unidirectional turning of the knob, in turn, projects and enables retraction of a set of plug pins for a certain country or group of countries.

4 Claims, 8 Drawing Sheets

FIG. 3
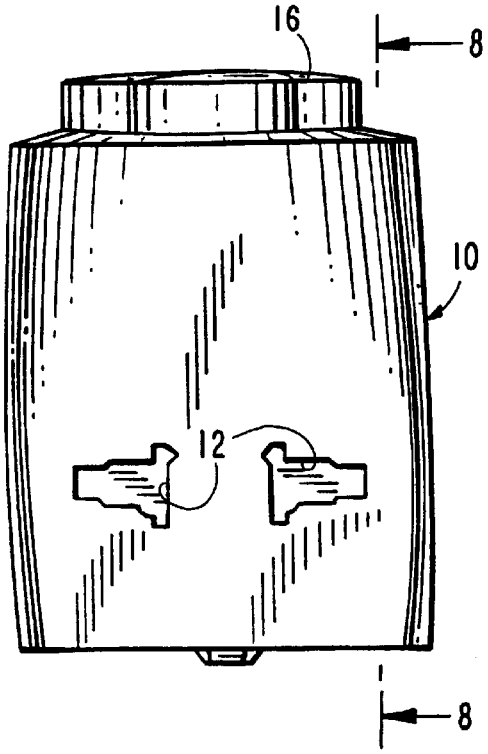
FIG. 4
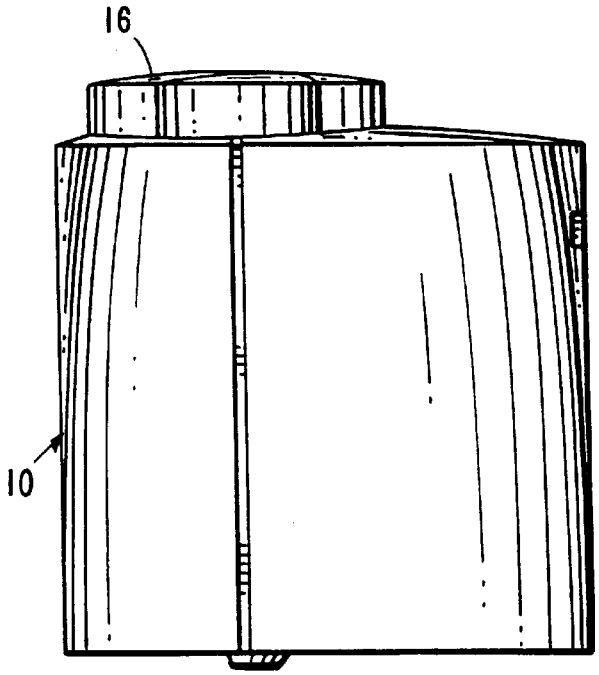
FIG. 5
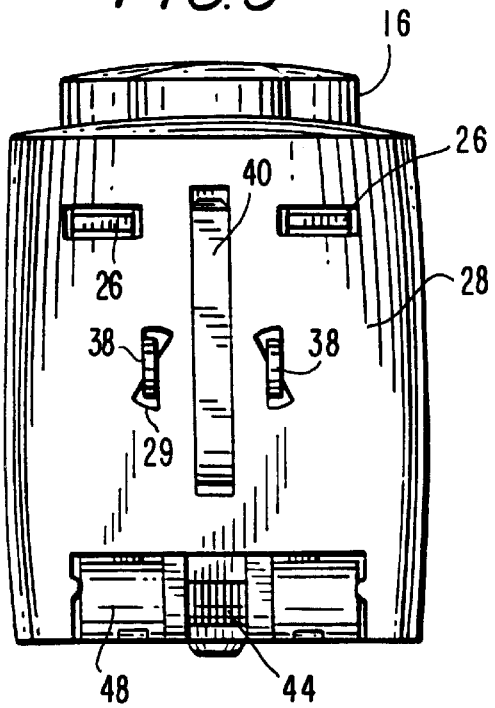
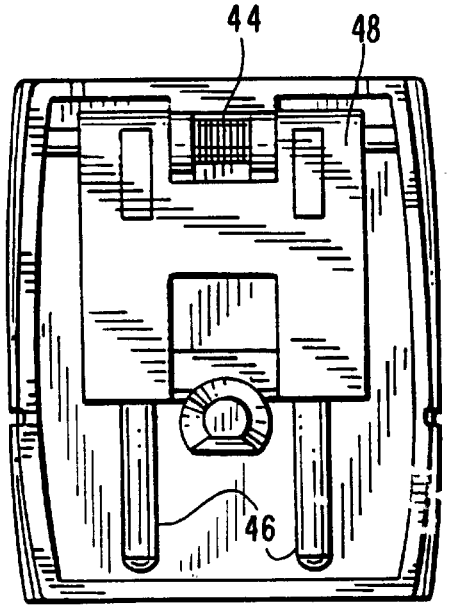
FIG. 6

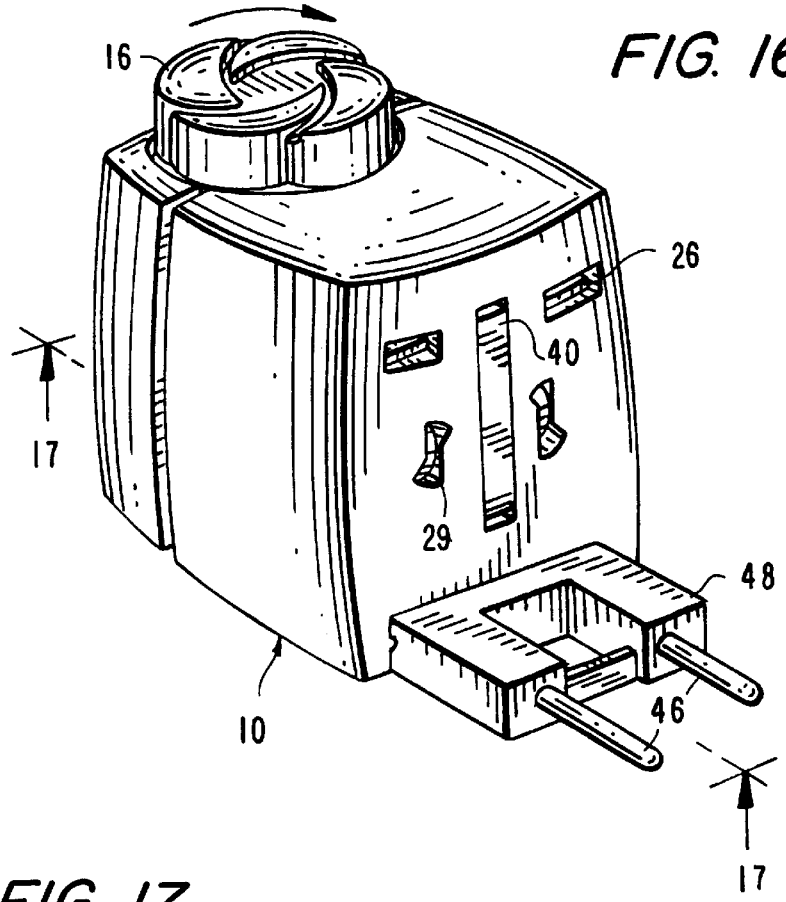
FIG. 16
FIG. 17
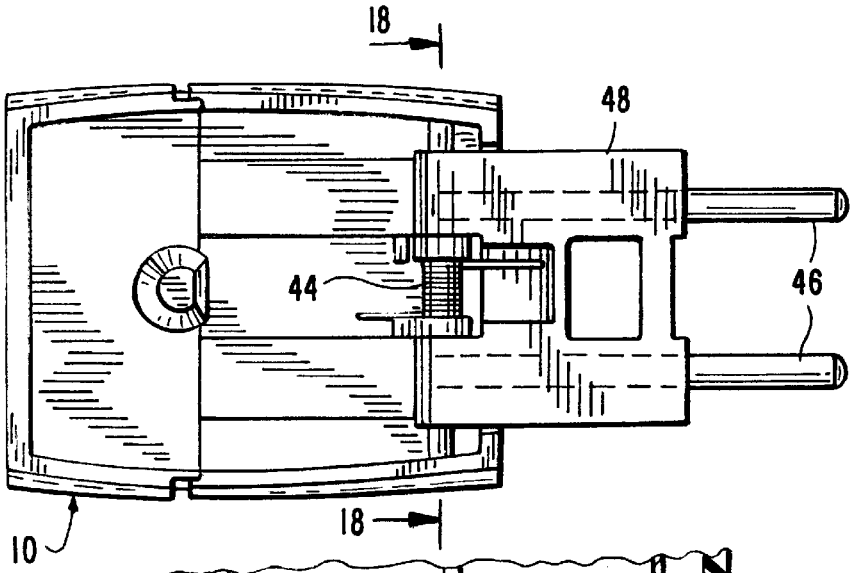
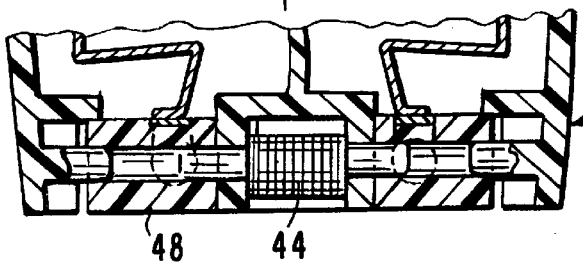
FIG. 18

WORLDWIDE ADAPTOR PLUG

FIELD OF THE INVENTION

This invention relates primarily to universal adaptor plugs for use in wide-ranging geographic areas throughout the world and more particularly to electric connection devices enabling the use of small electric appliances, not only in the home country of the user, but also for connection to wall outlets in various other countries throughout the world.

BACKGROUND OF THE INVENTION

When a user of small electric appliances travels from one country to the other throughout the world, it is often the case that each of the countries to which the user travels employs a different standard for the plugs and plug receptacles usable in that remote country.

Long ago, an adaptor plug involved the screwing in and screwing out of individual plug pins for several different plug systems. Of course, even with the aid of detailed operating instructions, the complication of changing plug pins, for instance, in the plug for a small electric appliance, was overwhelming, and presented a safety hazard when used by a non-skilled person.

A more sophisticated changeable plug pin system was developed by Peter Flohr in U.S. Pat. No. 4,856,999, issued Aug. 15, 1989, which involved a combination of spring-loaded contact arms and installation and screwing requirements for other parts, with various gripping surfaces, all of which provided a rather complex, occasionally unsatisfactory operational and safety hazard for the user.

In more recent years, Lee, in U.S. Pat. No. 5,159,545, issued Oct. 27, 1992, and the same inventor in U.S. Pat. No. 5,791,921, issued Aug. 11, 1998, improved the aforementioned drawbacks of adaptor elements, but not optimally. Indeed, the earlier Lee patent was disparaged by Lee himself in terms of the list of drawbacks of that earlier patent, at the introductory portion of the later patent.

The later Lee patent nevertheless used much of the technology and design of the earlier Lee patent, but substituted for the use of the user's fingers for changing the plug pin to be used, from the plug pin already exposed, which, in the earlier version presented a particular dexterity requirement difficult to satisfy for the user. The substitution of design and technology in the later Lee patent involved the use of seesaw buttons for making the adjustment from one plug pin arrangement to another.

OBJECTS AND SUMMARY OF THE INVENTION

Accordingly, it is a primary object of the present invention to provide a convenient and user-friendly, yet safe, universal adaptor, for insertion to plug receptacles in different parts of the world.

A further and more particular object is to provide a universal adaptor, which does not require the screwing in or screwing out of any parts, nor any other complex installation or use procedures which would complicate or make hazardous the use of the item.

A further and more specific object is to provide a universal adaptor which enables use of the item, virtually without depending upon knowledge of which set of buttons or switches need to be touched or used to change the plug size for use in a particular country to which the user is travelling.

Other objects and advantages of the present invention which are provided in a universal adaptor plug which features a single rotary cam element and various cam followers, with the axis for mounting cams turnable by the user by rotating a single knob for projecting into useable position plug pins for use in the U.K., Ireland, some African countries, Hong Kong, Singapore and other countries; for use in Australia, New Zealand, China, Fiji and other countries; for use in North and South America, Japan and some Caribbean and other countries; and in Europe, the Middle East, and in some other African, Asian and Caribbean countries. The adaptor plug works with U.S., British and European appliances, and thereby provides a plug receptacle which admits plug pins sold with such appliances. More specifically, a rotatable knob for making the changes in terms of exposing different plug pins for insertion to a wall plug receptacle, or the like, is intended for use by manual rotation in a single direction to sequentially provide the plug pin exposure needed for the country visited by the user.

BRIEF DESCRIPTION OF THE DRAWINGS

Other objects, features and advantages of the present invention will become apparent by the following more detailed description of the preferred, but nonetheless illustrative, embodiment of the present invention, with reference to the accompanying drawings wherein:

FIG. 3 is a rear elevational view thereof;

FIG. 4 is a left side elevational view thereof;

FIG. 5 is a front elevational view thereof, showing various sets of plug pins for adapting the present invention for use in different countries;

FIG. 6 is a bottom plan view thereof;

FIG. 16 is a view similar to that of FIGS. 11 and 13, and showing particularly the spring-loaded base for the plug pins suitable for use in certain countries of Europe, the Middle East and some African, Asian and Caribbean countries, in an extended position;

FIG. 17 is a bottom view taken from the line of sight shown by 17—17 of FIG. 16, illustrating the rotating lock in a non-engaging position with respect to the base of the plug pins, and the spring which rotates the base of the plug pins, following rotation of the main knob (cam axis), automatically into the position shown by FIG. 16 when the rotating lock disengages; and FIG. 18 is a rear sectional view taken along the line 18—18 of FIG. 17, and showing particularly the axis of rotation for the base rotating spring, along with the electrical contact elements for use of the plug pins of FIGS. 16 and 17.

DETAILED DESCRIPTION OF THE PREFERRED EMBODIMENT

Figure 1:
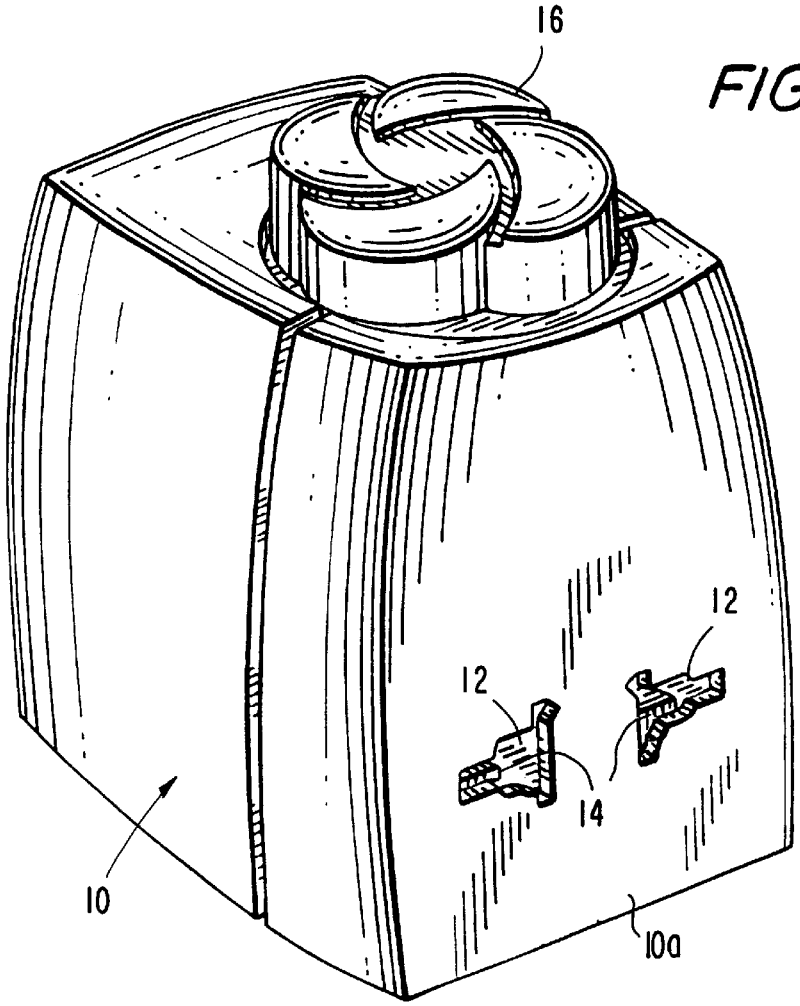
FIG. 1 is a right, rear and top isometric view of the present invention, showing particularly the rear face appliance plug receptacle, and more importantly, the rotatable knob for varying the country or countries to which the universal adapter is applicable.
Figure 2:
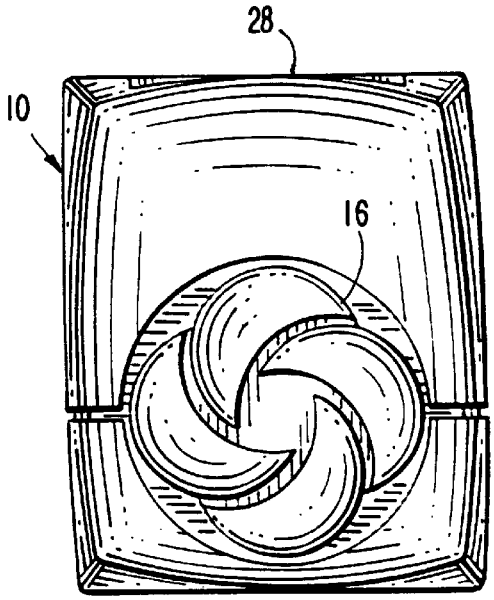
FIG. 2 is a top view of the universal adaptor of FIG. 1.
Figure 7:
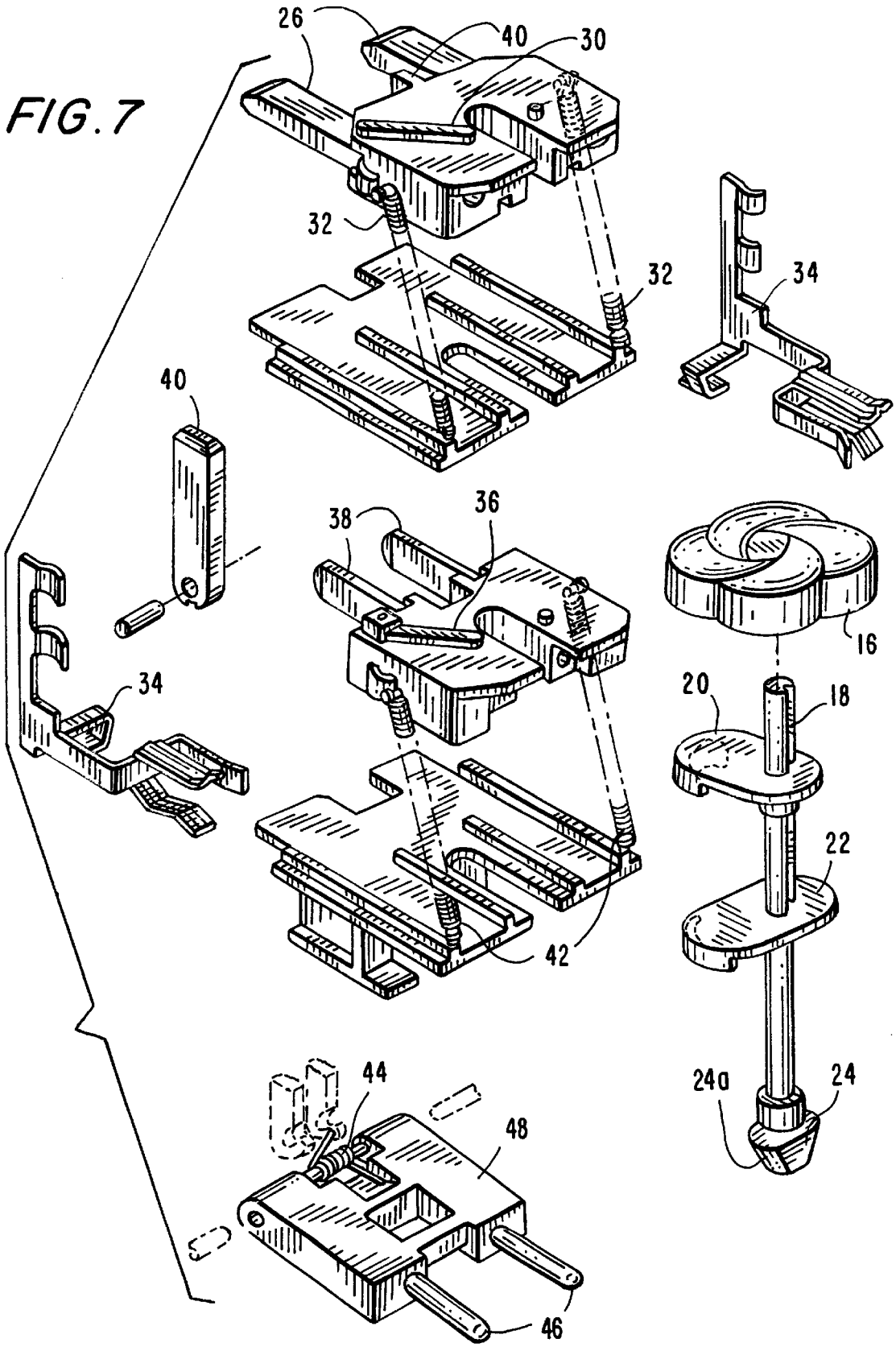
FIG. 7 is an exploded view showing the axis element for the camming action of the present invention as attached to the rotatable knob, various plug pins for various countries, with appropriate cam followers and retracting springs therefor.
Figure 8:
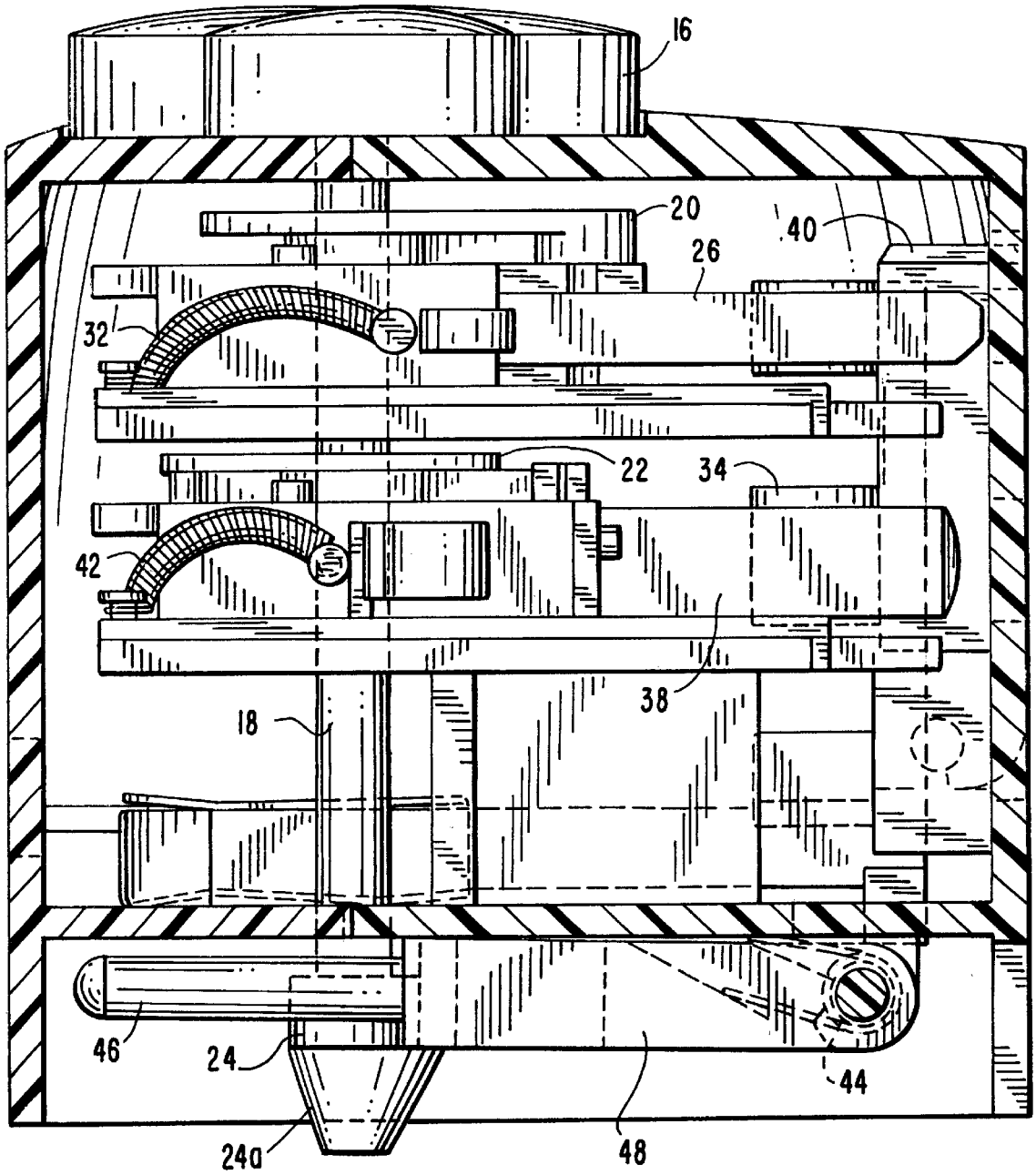
FIG. 8 is a left side sectional view showing the placement of the adapter elements, taken along the line 8—8 of FIG. 3.

As may be seen in FIG. 1, the rear face 10*a* of the casing, generally designated 10, defines openings 12 for plug receptacles 14 suitable to receive plug pins from appliances made within the United States, Great Britain and parts of continental Europe. Referring to FIGS. 1 and 7, particularly, rotatable knob 16 is rigidly connected to axis element 18 having cams 20, 22 and 24 rotating therewith, when the knob 16 is turned.

Figure 9:
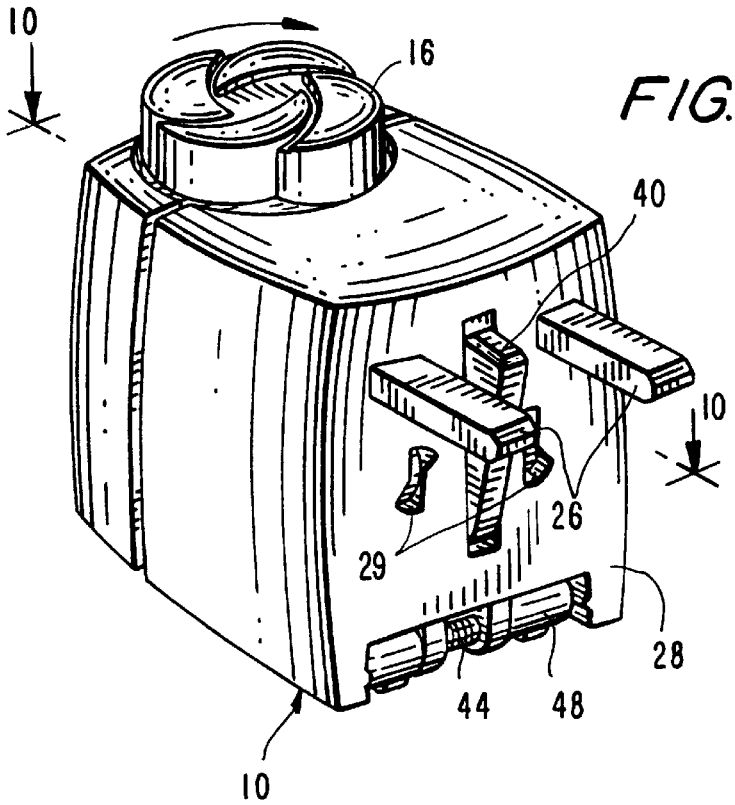
FIG. 9 is an isometric view of the present invention showing left side top and front; and with the U.K., Ireland, Africa, Hong Kong, Singapore plug pins protruding from the front of the adaptor, along with the insulating grounding element for use in these countries, as the knob is rotated in a clockwise direction to turn the cam axis and thereby move the cam follower for protruding such pins.
Figure 10:
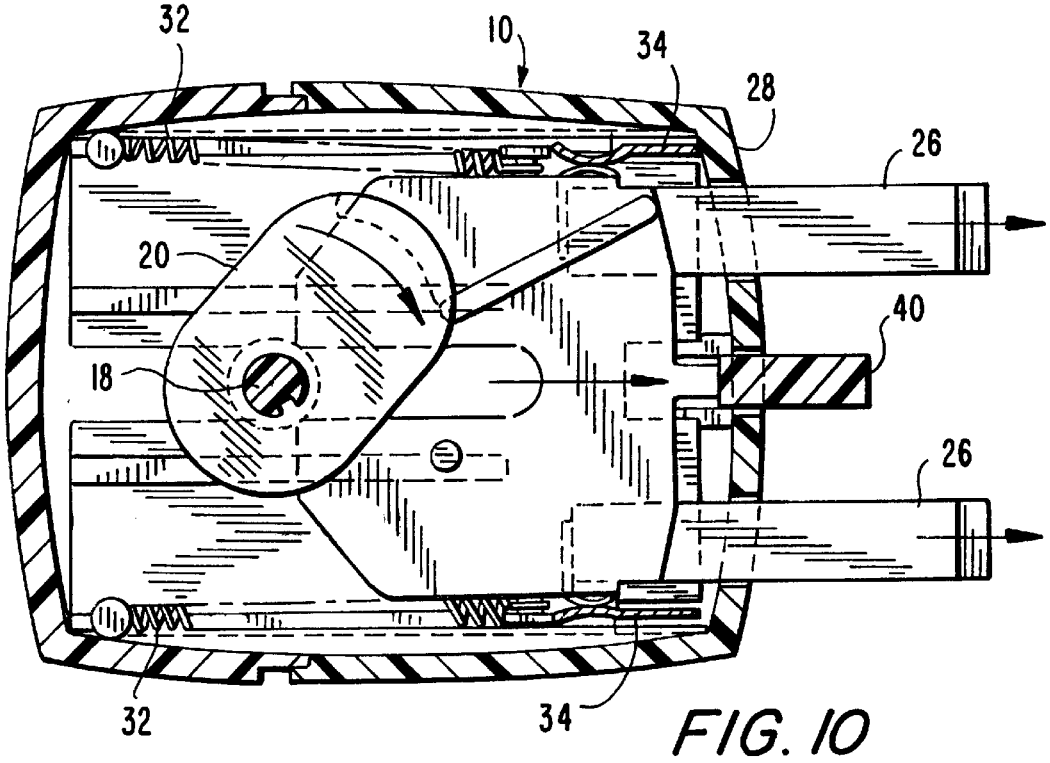
FIG. 10 is a top, sectional view taken along the line 10—10 of FIG. 9 and showing particularly the action of the cam and the cam follower to cause the adaptor to assume the position of pins and grounding pin shown in FIG. 9.

Cam 20 causes the plug pins 26 for U.K., Ireland, Africa, Hong Kong and Singapore usage (and some other countries) to protrude from the front face 28 of the casing 10, at the upper part thereof (FIG. 5). This outward protrusion of plug pins 26 is enabled by cam follower 30, with the retraction of plug pins 26 being enabled by springs 32 and the curvature of cam 20. As plug pins 26 protrude, insulating grounding element 40 (FIG. 9) also protrudes, but retracts as plug pins 38 are inserted to a plug receptacle following protrusion as will be described hereinafter.

Of course, the various electrical connections are made and altered with respect to contact stampings 34 and various wires and contacts as may or may not be shown in the drawings.

Figure 11:
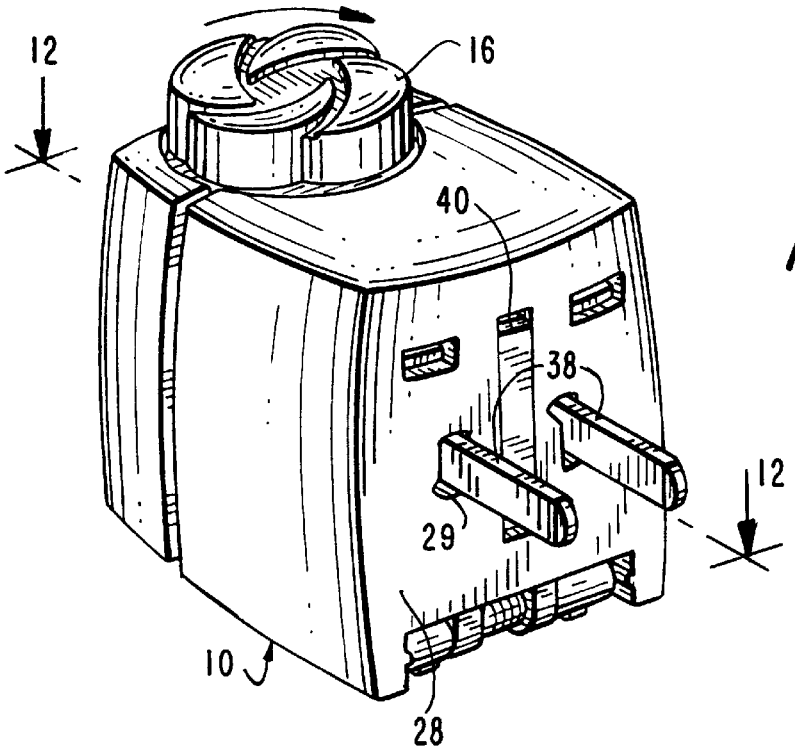
FIG. 11 is a view similar to that of FIG. 9, but with further rotation of the manually manipulated knob in the clockwise direction causing the protrusion of the plug pins for use in Australia, New Zealand, China, Fiji, North and South America, Japan and certain Caribbean countries; the view of FIG. 11 showing the plug pins both rotated to a vertical orientation, particularly suitable for North and South America, Japan and certain Caribbean countries.
Figure 12:
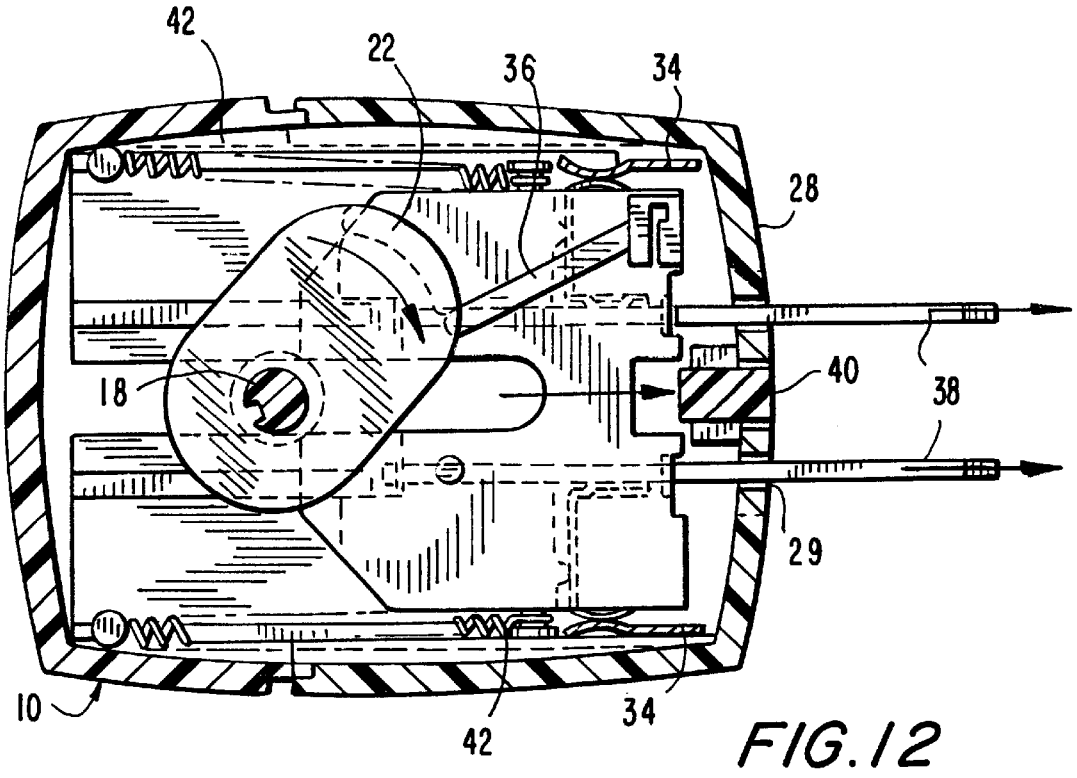
FIG. 12 is a more central top, sectional view taken along the line 12—12 of FIG. 11 and showing the action of the cam and the cam follower in causing the protrusion of plug pins as described with reference to FIG. 11.
Figure 13:
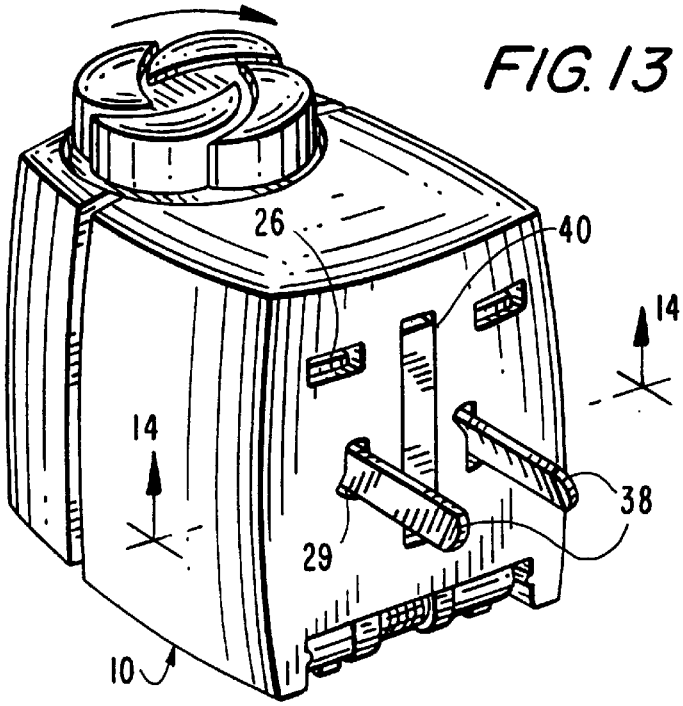
FIG. 13 is a view similar to that of FIGS. 9 and 11, but with the "American" oriented plug pins of FIG. 11 manually rotated to be suitable for Australia, New Zealand, China and Fiji.
Figure 14:
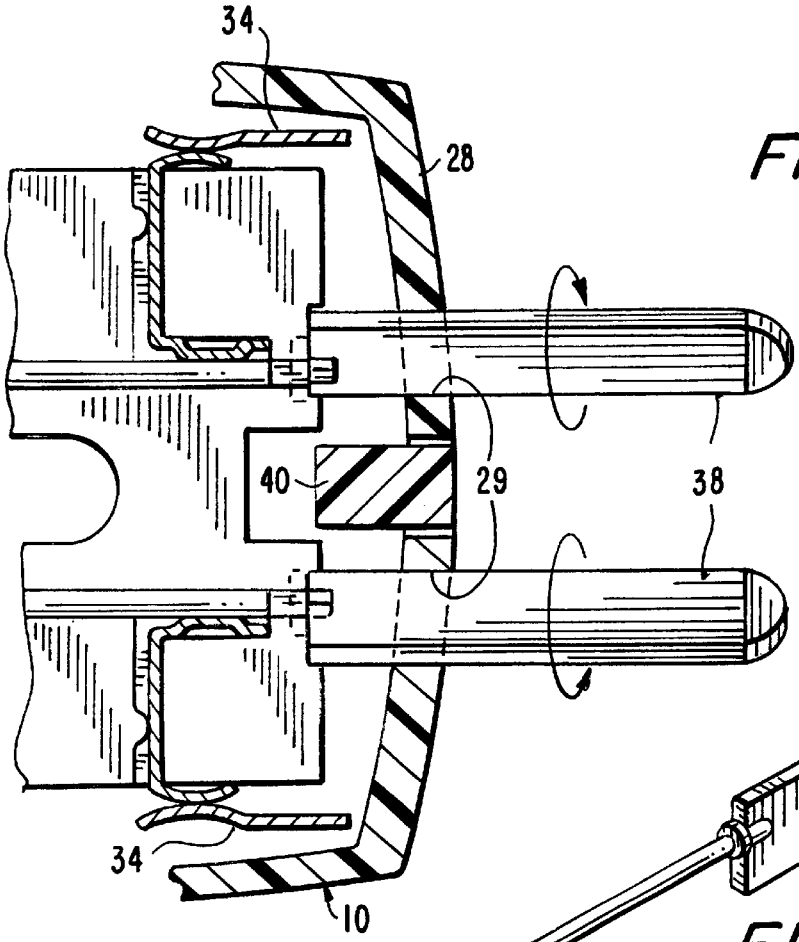
FIG. 14 is a bottom, sectional view taken along the line 14—14 of FIG. 13, and showing the manual rotation of plug pins to change from FIG. 11 to FIG. 13, in terms of the particular orientation of the plug pins.
Figure 15:
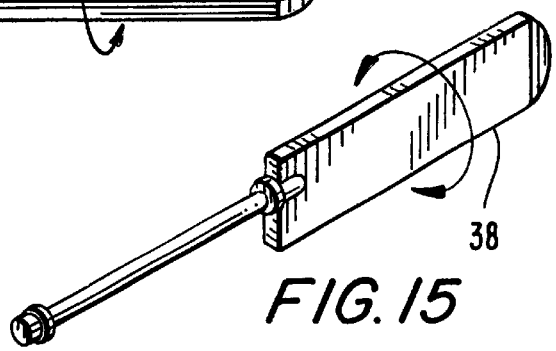
FIG. 15 is an isometric view of the one of the plug pins of FIG. 15 with its plug pin connector enabling rotation in either direction.

In the same manner, the action of cam 22 and follower 36 protrudes plug pins 38, as knob 16 is further turned in the clockwise direction, after retraction of plug pins 26. Initially, plug pins 38 are angularly disposed (see FIG. 13), for usage in Australia, New Zealand, China, Fiji and other countries. Simultaneously, as plug pins 38 are protruded, and plug pins 38 inserted to a receptacle, insulating grounding element 40 retracts. This action is enabled by cam follower 36 and the action of cam 22, with retraction enabled by the action of springs 42. Manual rotation of plug pins 38 (FIGS. 11, 14 and 15) enabled by openings 29 defined by face 28 of the casing allows plug pins 38 to assume a straight up-and-down orientation for use in North and South America, Japan, some Caribbean and other countries, prior to the time when plug pins 38 are retracted as per the above description.

Further clockwise rotation of knob 16 places flat face 24*a* of cam 24 in a front facing direction to enable the action of spring 44 to forwardly protrude plug pins 46 on base 48. Retraction of base 48 and plug pins 46 is manually enabled, while flat face 24*a* is still in a forward facing position. When plug pins 46 are provided forwardly, usage of the adaptor is enabled for continental Europe, the Middle East, some African, Asian and Caribbean countries, and other countries.

In order to provide an even more complete description of the present invention, the manner of use and position of elements are now described for a person travelling first to England, then to Australia, followed by trips to America and France, with a hair dryer produced in the U.S. Upon arrival in England, the person plugs in the hair dryer to receptacle openings 12 on the rear face 10*a* of the adaptor 10, and he or she turns knob 16 clockwise until plug pins 26 protrude outwardly, along with insulator grounding element 40. Further rotation of knob 16 retracts plug pins 26 and causes plug pins 38 to protrude for use in Australia upon the person's arrival in that country. Plugging the adaptor into a plug receptacle in Australia pushes element 40 flush with the front face 28 and after the plug pins 38 protrude, in an angular position suitable for use in Australia. The person then returns to the U.S., manually aligns plug pins 38 parallel to each other and proceeds to use the adaptor.

Upon travel to France, further clockwise turning of knob 16 retracts plug pins 38 and protrudes base 48 and its plug pins 46, with such elements being manually retractable as flat face 24*a* of cam 24 is still in a forwardly facing position.

Of course, markings on the front face of the casing near the plug pins of the names of countries in which such pins are used, would add a convenience for the user.

While the foregoing description sets forth the elements and their function for the present invention, in a complete manner, the coverage of the present invention is to be limited only by the following claims:

What is claimed is:

1. A universal adaptor plug for use in various geographic areas, with an appliance sold in some of those geographic areas, connected to said plug comprising:

(a) a casing onto which is mounted a rotatable knob attached to a cam-mounting first axle, said casing having a first face defining openings;

(b) a first plug pin base;

(c) a first set of plug pins attached to said first base;

(d) a first cam rotatable with said first axle for protruding said first set of plug pins outside of said casing through said openings;

(e) a first cam follower for moving said first set of plug pins responsive to rotation of said first axle and said first cam;

(f) a first spring for retracting said first set of plug pins;

(g) a second plug pin base;

(h) a second set of plug pins attached to said second base;

(i) a second cam rotatable with said first axle for protruding said second set of plug pins outside of said casing, through said openings;

(j) a second cam follower for moving said second set of plug pins responsive to rotation of said first axle and said second cam;

(k) a second spring for retracting said second set of plug pins;

(l) all adapted and arranged, with manual turning of said knob, to select which of said sets of plug pins is protruded, as required by the geographic area in which said appliance is to be used.

2. A universal adaptor plug according to claim 1 wherein said second set of plug pins is rotatably attached to said second base, to rotate between a first vertical position and a second angular position.

3. A universal adaptor plug according to claim 1 wherein an insulating grounding element protrudes from said casing between said first set of plug pins, simultaneously with the protrusion of said first set of plug pins, particularly for use in the U.K.

4. A universal adaptor plug according to claim 1 wherein a third plug pin base is provided and rotatably connected to said casing; and a second axle is provided in an orientation perpendicular to said first axle for rotatably mounting said third base to said casing; a spring encircling said second axle is provided for use in connection with protrusion and retraction of said third base; a third cam rotatable with said first axle controls the motion of said third base, and a pair of third plug pins is attached to said third base.

* * * * *